US007520945B2

(12) United States Patent
Dumont et al.

(10) Patent No.: US 7,520,945 B2
(45) Date of Patent: Apr. 21, 2009

(54) RECRYSTALLIZED AL-ZN-CU-MG PLATE WITH LOW ZIRCONIUM

(75) Inventors: David Dumont, Romans sur Isere (FR); Vic Dangerfield, Parkersburg, WV (US)

(73) Assignees: Alcan Rhenalu, Paris (FR); Alcan Rolled Products - Ravenswood, LLC, Ravenswood, WV (US)

( * ) Notice: Subject to any disclaimer, the term of this patent is extended or adjusted under 35 U.S.C. 154(b) by 440 days.

(21) Appl. No.: 11/012,357

(22) Filed: Dec. 16, 2004

(65) Prior Publication Data

US 2005/0167016 A1 Aug. 4, 2005

Related U.S. Application Data

(60) Provisional application No. 60/529,593, filed on Dec. 16, 2003.

(51) Int. Cl.
*C22C 21/10* (2006.01)
*C22F 1/053* (2006.01)

(52) U.S. Cl. ..... 148/417; 420/532; 148/693; 148/694

(58) Field of Classification Search ..... 148/417, 148/693, 694; 420/532
See application file for complete search history.

(56) References Cited

U.S. PATENT DOCUMENTS

| | | | | |
|---|---|---|---|---|
| 4,569,703 | A * | 2/1986 | Baba et al. | 148/417 |
| RE34,008 | E * | 7/1992 | Quist et al. | 148/417 |
| 5,277,719 | A | 1/1994 | Kuhlman et al. | |
| 6,027,582 | A | 2/2000 | Shahani et al. | |
| 2002/0011289 | A1 * | 1/2002 | Warner | 148/437 |
| 2002/0121319 | A1 * | 9/2002 | Chakrabarti et al. | 148/694 |

FOREIGN PATENT DOCUMENTS

| | | |
|---|---|---|
| EP | 1 158 068 A1 | 11/2001 |
| EP | 1 544 316 A2 | 6/2005 |
| WO | 97/27343 | 7/1997 |

OTHER PUBLICATIONS

Connolly et al, "Environmentally Assisted Crack Growth Rates of High-Strength Aluminum Alloys", Jan. 2003, pp. 49-52.

* cited by examiner

*Primary Examiner*—Roy King
*Assistant Examiner*—Janelle Morillo
(74) *Attorney, Agent, or Firm*—Baker, Donelson, Caldwell, Bearman & Berkowitz PC

(57) ABSTRACT

The present invention is directed to optimization of recrystallization rates on the fatigue crack growth resistance, in the particular case of a Al—Zn—Cu—Mg plate products, and especially on the evolution of da/dN.

18 Claims, 7 Drawing Sheets a)

b)

RECRYSTALLIZED AL-ZN-CU-MG PLATE WITH LOW ZIRCONIUM

CROSS REFERENCE TO RELATED APPLICATIONS

The present application claims priority from U.S. Provisional Application Ser. No. 60/529,593, filed Dec. 16, 2003, the content of which is incorporated herein by reference in its entirety.

BACKGROUND OF THE INVENTION

1. Field of the Invention

The present invention relates generally to aluminum alloys and more particularly, to Al—Zn—Cu—Mg alloys, their methods of manufacture and use, particularly in the aerospace industry.

2. Description of Related Art

A tremendous work has been done during the last decades to improve properties of 7xxx series alloys, and more particularly their strength/toughness balance. U.S. Pat. No. 6,027,582 assigned to Pechiney Rhenalu discloses an Al—Zn—Cu—Mg product with a recrystallization rate not exceeding 35% between quarter-thickness and half-thickness. However microstructure relationships with their fatigue crack growth resistance (FCGR) need still to be clarified.

SUMMARY OF THE INVENTION

The present invention presents products and methods to improve the fatigue crack growth resistance of plate in Al—Zn—Cu—Mg alloys.

In accordance with the present invention, there are provided products, methods and uses that optimize recrystallization rates on fatigue crack growth resistance, in the particular case of a Al—Zn—Cu—Mg products, and especially on the evolution of da/dN.

Additional objects, features and advantages of the invention will be set forth in the description which follows, and in part, will be obvious from the description, or may be learned by practice of the invention. Objects, features and advantages of the invention may be realized and obtained by means of the instrumentalities and combination particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the detailed description of a preferred embodiment given below, serve to explain principles of the invention.

FIG. 1 shows dimensions of FCGR specimens according to one embodiment of the present invention.

FIG. 2 shows results of FCG tests on a reference plate (N° 856385) according to an embodiment of the present invention.

FIG. 3 is an SEM characterization of fracture surfaces of a reference material.

FIG. 4 shows results of FCG tests on a plate rolled with a lower exit temperature.

FIG. 5 shows results of FCG tests on a plate with a lower Zr content.

FIG. 6 shows a crack path comparison near the threshold for reference (a) and low Zr (b) materials according to one embodiment.

FIG. 7 depicts a schematization of FCGR differences between reference and low Zr materials according to one embodiment.

DETAILED DESCRIPTION OF A PREFERRED EMBODIMENT

Figure 1:
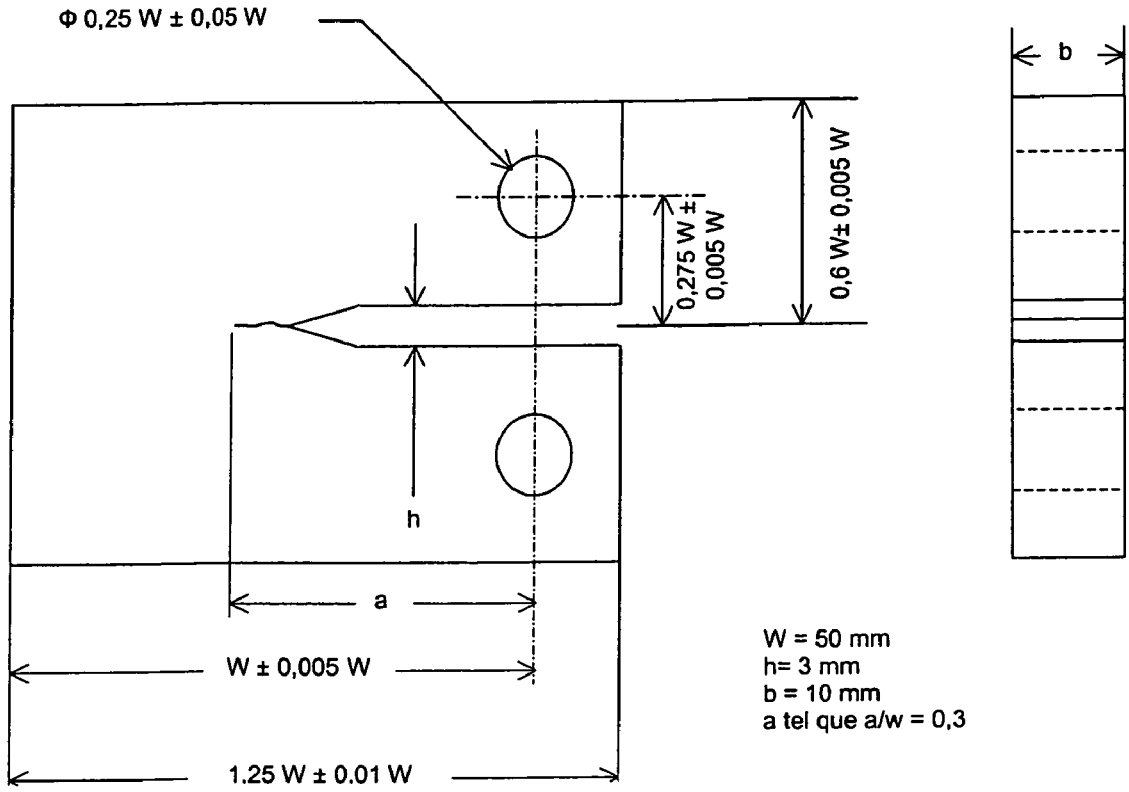
FIGS. 1-7 are directed to certain aspects of the invention as described herein. They are illustrative and not intended as limiting.

The present invention can be applied to alloys of the Al—Zn—Cu—Mg type, i.e. to aluminum alloys which comprise Zn, Cu and Mg as alloying elements. It can be applied especially to alloys of the Al—Zn—Cu—Mg type belonging to the 7xxx series. One preferred alloy comprises (in wt.-%): 5.8-6.8% Zn, 1.5-2.5% Cu, 1.5-2.5% Mg, 0.04-0.09% Zr, remainder aluminum and incidental impurities. Preferably, the residual iron content is below 0.09%, and the residual silicon content below 0.07%. Another preferred alloy is AA7040.

In a preferred embodiment, the zirconium content in between about 0.05 and about 0.07%.

Such alloys can be cast as rolling ingots, and can be transformed into plates using conventional transformation schedules. These transformation schedules preferably comprise at least one hot rolling step.

A product according to the present invention is preferably a plate with a thickness of at least about 6 mm, because certain technical effects of the present invention are especially evident in flat rolled products which are not completely recrystallised. Thin sheet may likely to be completely recrystallized. In an advantageous embodiment, the thickness is at least about 15 mm, and preferably at least about 20 mm. The thickness can reach or even exceed about 100 mm in some cases.

A product according to the present invention preferably has a recrystallization rate at quarter thickness (E/4) of at least about 35%, and preferably of at least about 50%, but advantageously should not be completely recrystallized. A recrystallization rate of 90% or less is preferred. Recrystallization rates of from 35%-90% are advantageous in some embodiments.

The fatigue crack propagation rate in such a plate according to the present invention is preferably less than or equal to about $10^{-4}$ mm/cycle at $\Delta K=10$ MPa$\sqrt{m}$ for a test at R=0.1 in the L-T direction at E/4.

A plate according to the instant invention in one embodiment preferably comprises (in wt.-%): 5.8-6.8% Zn, 1.5-2.5% Cu, 1.5-2.5% Mg, 0.04-0.09% Zr, remainder aluminum and incidental impurities, or a plate in AA7040. A plate product of the present invention can have a fracture toughness $K_{IC(L-T)}>30$ MPa$\sqrt{m}$, and preferably also a fracture toughness $K_{IC(T-L)}>25$ MPa$\sqrt{m}$, and still more preferably in addition to these two values a fracture toughness $K_{IC(S-T)}>25$ MPa$\sqrt{m}$.

An inventive product as described herein can be manufactured by any suitable process such as a process comprising at least one hot rolling step at an exit temperature below about 420° C. This plate can then be subjected to a T7651 treatment, which can include artificial aging.

Products of the present invention include Al—Zn—Cu—Mg materials such as plates. Al—Zn—Cu—Mg products of the present invention include those comprising from about 0.04-about 0.09 wt % Zr, wherein the product possesses a recrystallization rate greater than about 35% at a quarter thickness location. In a preferred embodiment, the present invention provides an Al—Zn—Cu—Mg product comprising (in weight %):

5.8-6.8% Zn 1.5-2.5% Cu 1.5-2.5% Mg 0.04-0.09% Zr remainder aluminum and incidental impurities. Incidental impurities are defined as those identified by the Aluminum Association for 7xxx alloys in the amounts specified thereby. Further, the amounts above can deviate slightly from the ranges given if desired so long as the properties do not change in any measurable way.

In many cases, the present invention is directed to a product or plate possessing a recrystallization rate greater than about 35% at a quarter thickness location. Measurements at a quarter thickness location are conducted according to methods well known in the art. In some embodiments Zr is advantageously present in an amount from about 0.05-0.07 wt %. In another embodiment a recrystallization rate greater than about 50% at a quarter thickness location is provided. The fatigue crack growth rate is advantageously less than about $10^{-4}$ mm/cycle at $\Delta K=10$ MPa$\sqrt{m}$ for a test performed at R=0.1 in the L-T direction at the T/4 location.

The present invention is also directed to methods for making products including plates. Methods of the present invention advantageously comprise rolling a precursor of the product to be made at temperature that is preferably at most about 420 degrees C. Advantageously in some embodiments the product or plate is subjected to T7651 temper.

In connection with the present invention, a reference material in alloy AA7040 presenting a 20% recrystallization rate was compared with two other highly recrystallized materials (60%):

1. Plate rolled at a lower temperature that is at most about 420° C., preferably from 300-419 degrees, more preferably from 305-350 degrees, and in some cases, at about 315 degrees C.
2. Plate with a lower Zr content: 0.06 instead of 0.11 wt %.

The recrystallization rate itself has a small effect in near-threshold regions; nominal curves are slightly different due to a roughness induced closure effect, the crack path being more tortuous.

Moreover an interesting difference has been found by the present inventors when comparing reference material (AA7040 20% recrystallization) and the inventive material, i.e. those with the 420 degree or lower rolling temperature and those with low Zr content. The low Zr materials present significantly lower crack propagation rates on a large $\Delta K$ range: 8 to 20 MPa $\sqrt{m}$, where no closure effect is observed. This difference would be attributed to an intrinsic effect of the low Zr material microstructure. This behavior is schematized in FIG. 7. Similar results are also present with respect to other highly recrystallized materials that were rolled at temperatures of about 420 degrees C. or lower.

The recrystallized grains of the low Zr content material are preferably larger than the grains of AA7040 identified above. Thus it is advantageous to cold roll the materials to obtain a comparable microstructure in terms of grain size and then test and compare fatigue crack growth resistance between the inventive and comparison materials.

These as well as other aspects of the present invention are explained in more detail with regard to the following illustrative and nonlimiting examples:

EXAMPLES

Experimental Procedure

A) Material

All specimens were sampled in 100 mm thick 7040 plates that were processed on industrial equipment. Individual plate numbers and their corresponding chemical composition are indicated in Table 1, their mechanical properties in Table 2, and their recrystallization rates and processing conditions in table 3:

TABLE 1

| | Chemical composition | | | | | | |
|---|---|---|---|---|---|---|---|
| Plate N° | Si | Fe | Cu | Mg | Zn | Ti | Zr |
| 856385 | 0.035 | 0.072 | 1.72 | 1.89 | 6.37 | 0.039 | 0.111 |
| 859188 | 0.029 | 0.059 | 1.59 | 1.87 | 6.39 | 0.021 | 0.060 |
| 859198 | 0.031 | 0.063 | 1.60 | 1.91 | 6.36 | 0.038 | 0.113 |

TABLE 2

| | Mechanical properties | | | | | |
|---|---|---|---|---|---|---|
| | $K_{IC}$ [MPa$\sqrt{m}$] | | | Tensile Yield Strength [MPa] | | |
| Plate N° | L-T | T-L | S-L | L | LT | ST |
| 856385 | 28.8 | 24.2 | 26.9 | 506 | 501 | 490 |
| 859188 | 31.6 | 26.6 | 26.8 | 508 | 504 | 475 |
| 859198 | 28.3 | 25.1 | 25.8 | 492 | 492 | 466 |

TABLE 3

| | Recrystallization rates and processing features | | | |
|---|---|---|---|---|
| | | % recrystallization | | |
| Material | Plate N° | T/4 | T/2 | Main feature |
| Low % rec (reference) | 856385 | 20% | 17% | Typical rolling temperature (exit around 430° C.) and typical Zr level (0.11%). |
| High % rec | 859198 | 60% | 55% | Lower exit rolling temperature: 315° C., typical Zr |
| | 859188 | 60% | 58% | Lower Zr content: 0.06%, typical rolling exit temperature (exit around 455° C.) |

Recrystallization rates (% rec) were measured by image analysis. The plate N° 856385 was representative of usual industrial production and can generally be considered as a reference: standard chemistry and processing. In order to investigate the recrystallization rate influence on FCGR, 856385 was compared with two other plates presenting % rec that are significantly higher:

Plate N° 859198 was rolled at a lower temperature. This modified rolling resulted in a higher stored energy and hence favored a more pronounced recrystallization during the subsequent solution heat treatment;

Plate N° 859188 with a lower Zirconium content and hence a lower quantity of dispersoids to inhibit recrystallization by grain boundary pinning.

All samples were received and tested in the T7651 temper. The three plates present comparable static and toughness properties. Moreover recrystallization rates were determined through image analysis with the Imagetool™ software. Measurements were performed in L-ST planes after chromic etching. Accuracy of this characterization is around 2%.

B) Mechanical Characterization

Classical tensile testing and fracture toughness characterization was carried out. Fatigue Crack Growth Rate (FCGR) measurements were performed in accord with ASTM E647 in air, the protocol of which is incorporated herein by reference in its entirety, with CT50 specimens (see FIG. 1). These trials were conducted in L-T and T-L orientations for the three materials, specimens being sampled at T/4. The reference material has been as well tested at T/2 in L-T orientation.

Tests were conducted with a cyclic load frequency of 35 Hz and a load ratio of 0.1. Fatigue crack length was continuously monitored by a compliance technique. It was also evaluated through optical observation of the specimen surface, after polishing. The fatigue crack growth threshold stress intensity range, $\Delta K_{th}$, was arbitrarily defined as the stress intensity factor range, ΔK, which corresponds to a fatigue crack growth rate, da/dN, of $10^{-10}$ m/cycle.

Tests were interrupted before final fracture in order to characterize the crack path. For this purpose, the surface of the specimen was observed optically, after etching (perpendicular to the crack propagation plane). Following FCG tests, post fracture surface morphologies were examined by scanning electron microscopy. A correction due to the closure effect was systematically applied in order to rationalize observed differences.

Results

A) Reference Material

Figure 2:
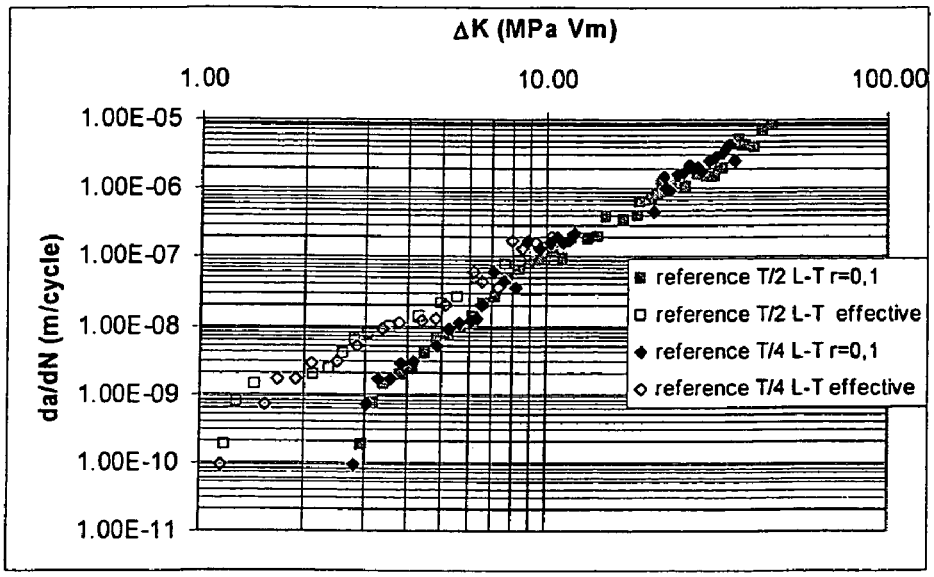
Figure 2:
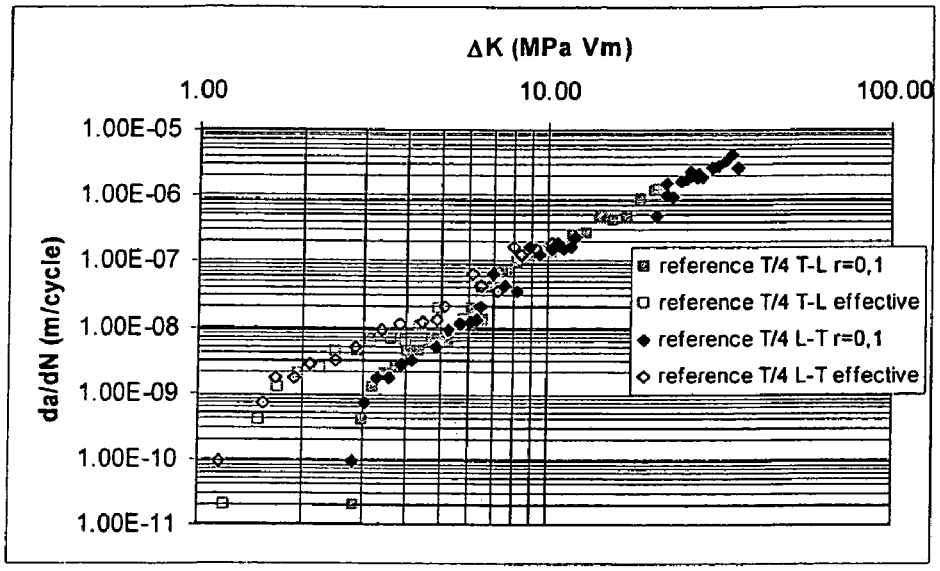

FIG. 2 shows fatigue crack growth in air through reference material (low % rec). (a) Influence of the specimen location (T/2 vs. T/4), (b) Influence of the specimen orientation (L-T vs. T-L), "Effective" curves take into account the closure effect correction. All tests were conducted with a load ratio R of 0.1.

No significant effect of the specimen orientation or location was observed on FIG. 2. At a macroscopic scale, the crack path appears to be very regular and not very tortuous in the three cases. Fracture surfaces display comparable behaviors (see FIG. 3): the fracture path is mainly transgranular with a lot of facets. Some decohesions of coarse intermetallic constituents and of grain boundaries were also observed. Moreover crack paths in the near-threshold regions were flatter with larger facets.

Figure 3:
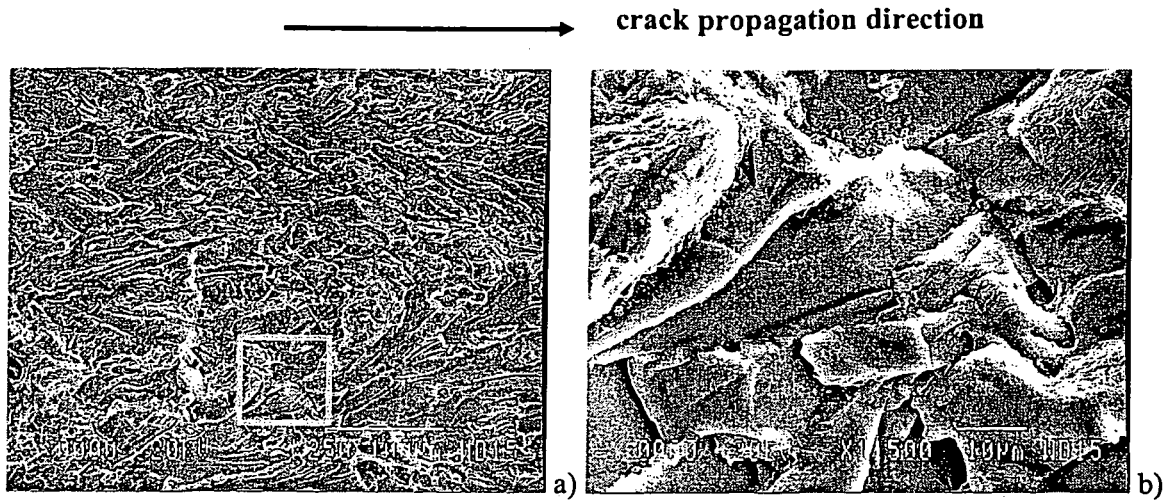

See FIG. 3 that shows SEM characterization of fracture surfaces of the reference material, tested in L-T direction at T/4 (ΔK=6 MPa√m, da/dN=1,6.10-8 m/cycle).

B) Low Rolling Temperature Material

Figure 4:
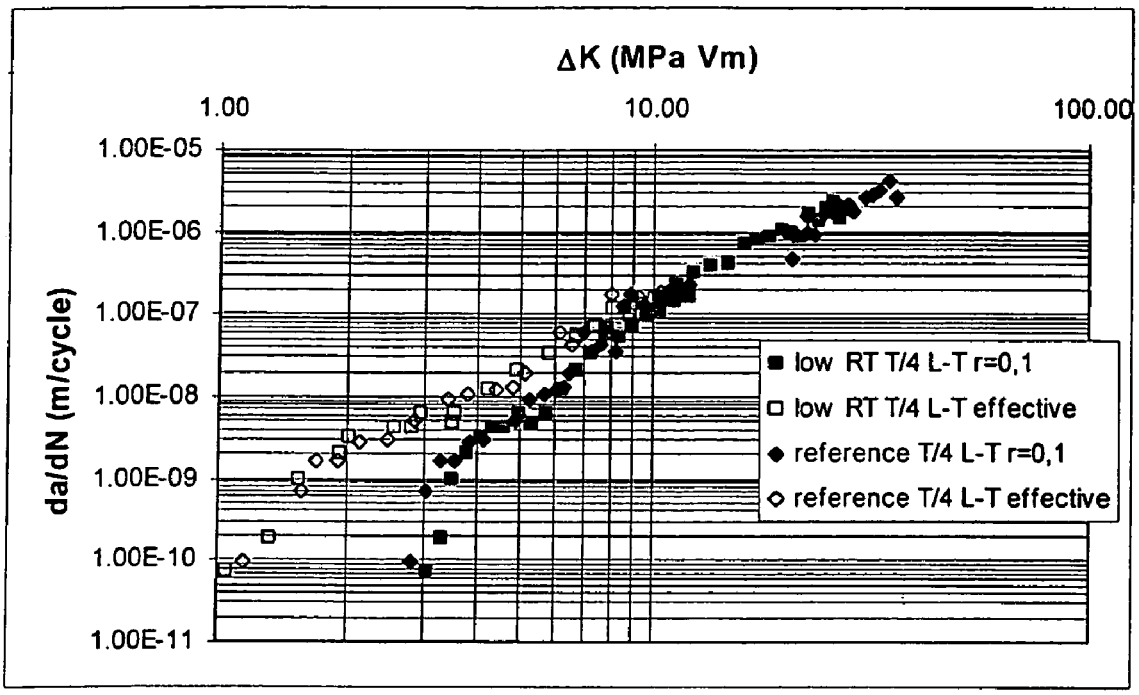

FIG. 4 shows fatigue crack growth in air through low rolling temperature (low RT) material (below about 420 degrees C.) (high % rec) in L-T direction. This was compared with the reference material (low % rec). All tests were conducted with a load ratio R of 0.1.

A slight difference was observed when comparing nominal curves of reference and low RT materials, in the near-threshold region. This difference disappeared when taking into account the closure correction (see effective curves on FIG. 4). The slight nominal difference may be explained by a roughness induced closure effect (more tortuous crack path).

C) Low Zr Material

Figure 5:
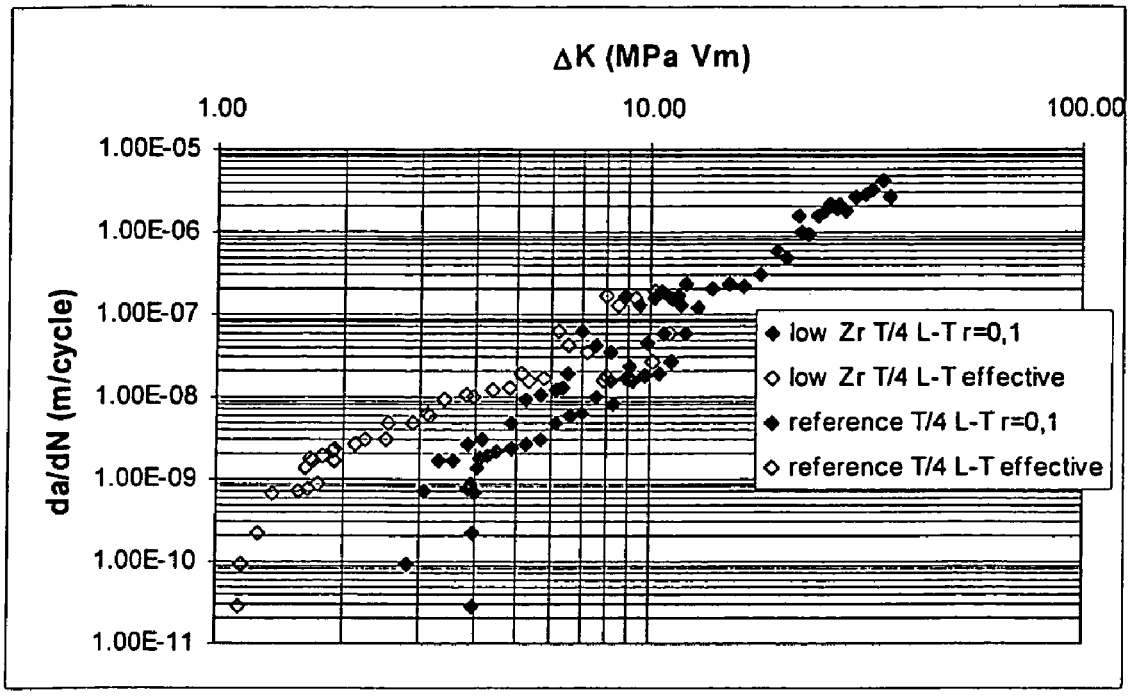

Results of FCG tests on the plate with a lower Zr content are shown in FIG. 5. Crack propagation rates were lower, as compared with the reference material, in a large ΔK range: 4 to 20 MPa√m.

This difference can likely be attributed to a roughness induced closure effect in the [1.2-8] MPa√m ΔK range. The crack path was indeed more tortuous for the low Zr material (see FIG. 6). Fracture surfaces were mainly transgranular as for the two other materials and present a large quantity of secondary cracks.

Figure 7:
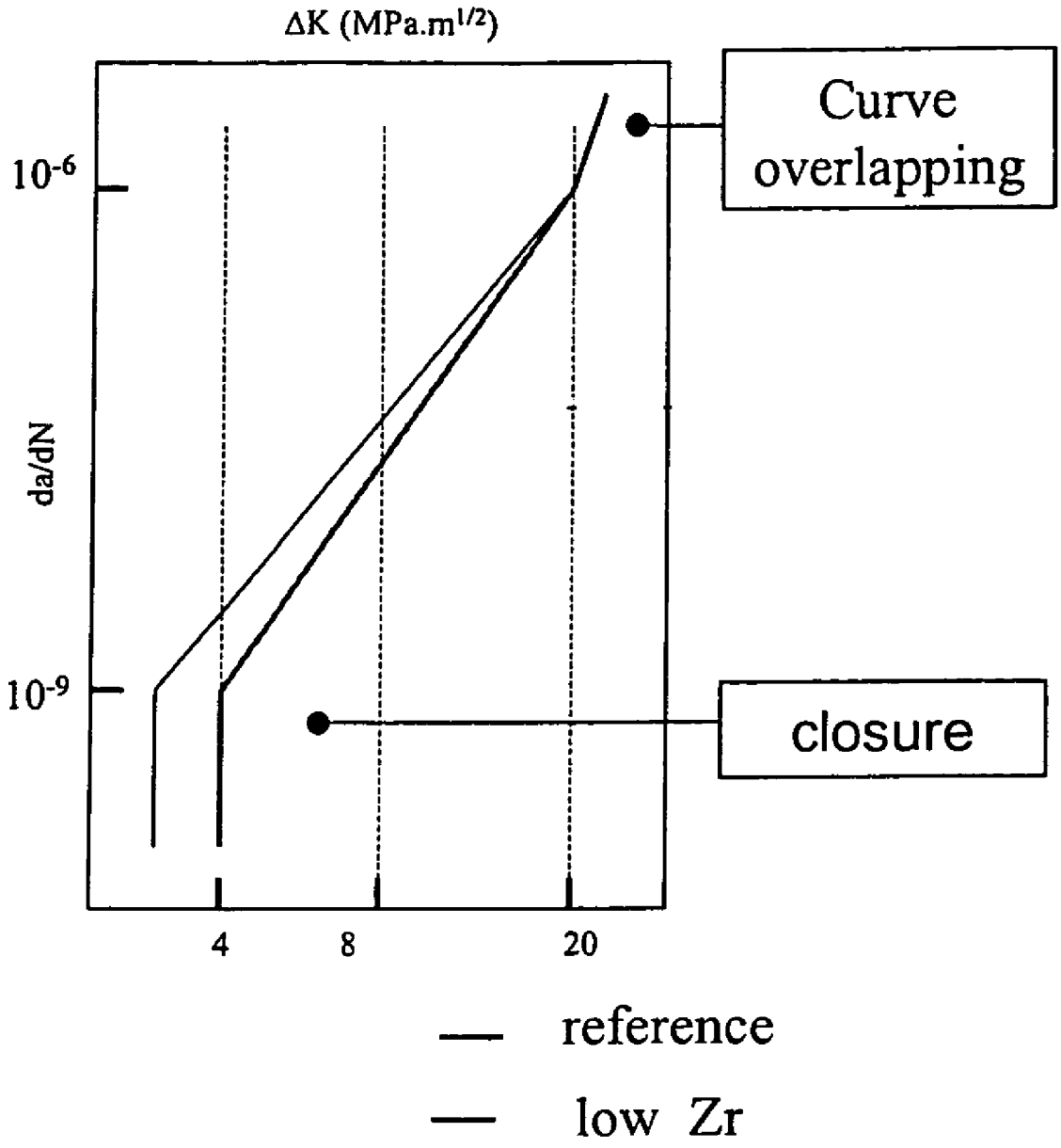

However no closure effect was evidenced in the [8-20] MPa√m ΔK range: nominal and effective curves overlap. This tends to show that the difference with the reference material in this ΔK range can be attributed to an intrinsic effect of the low Zr material microstructure. A schematization of this behavior is shown in FIG. 7.

A comparable behavior is observed in the T-L orientation. However differences were smaller.

FIG. 5 shows fatigue crack growth in air through the low Zr material (high % rec) in L-T direction. Comparison with the reference material (low % rec). All test were conducted with a load ratio R of 0.1.

Figure 6:
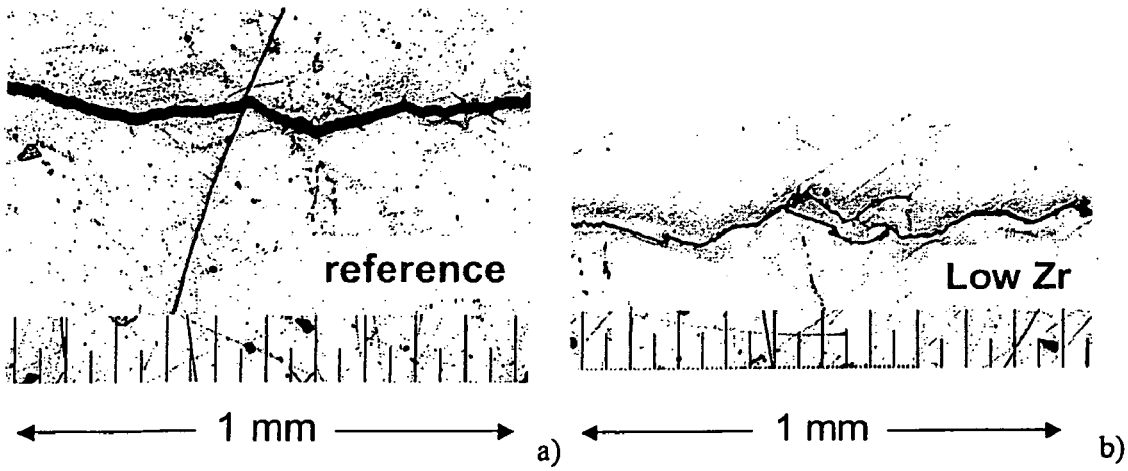

FIG. 6 shows crack path comparison near the threshold for reference (a) and low Zr (b) materials. Samples tested in L-T orientation, at T/4.

FIG. 7 is a schematization of FCGR differences between reference and low Zr materials. (Curve on the right: low Zr. Curve on the left: Reference).

The present invention provides inter alia an understanding of effects of recrystallization rates on the fatigue crack growth resistance, in the particular case of the 7040 alloy. For this purpose a reference material presenting a 20% recrystallization rate was compared with two other highly recrystallized (60%) materials. The materials were treated as follows:

Plate rolled at an lower temperature, i.e., at about 315° C.,

Plate with an even lower Zr content: of 0.06.

It may be first concluded that the recrystallization rate itself has a small effect in the near-threshold regions: nominal curves are slightly different due to a roughness induced closure effect. The crack path is indeed more tortuous.

Moreover an interesting difference has been underlined when comparing reference and low Zr content materials. The latter presents significantly lower crack propagation rates on a large ΔK range: 8 to 20 MPa√m, where no closure effect is observed. This difference would be attributed to an intrinsic effect of the low Zr material microstructure.

The term "plate" as used herein connotes any thickness of an aluminum alloy such as those commonly used in the aerospace industry. The term "product" includes any aluminum alloy.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

As used herein and in the following claims, articles such as "the", "a" and "an" can connote the singular or plural.

All documents referred to herein are specifically incorporated herein by reference in their entireties.

What is claimed is:

1. An Al—Zn—Cu—Mg AA7040 plate product with a thickness of at least about 15 mm comprising:

from about 0.05 to about 0.09 wt % Zr, wherein said product possesses a recrystallization rate greater than 60% at the quarter thickness location.

2. A product according to claim 1, wherein Zr is present in an amount from about 0.05to about 0.07 wt %.

3. A product according to claim 1, having a fatigue crack growth rate less than about $10^{-4}$ mm/cycle at $\Delta K=10$ MPa$\sqrt{m}$ for a test performed at R=0.1 in the L-T direction at the T/4 location.

4. An Al—Zn—Cu—Mg alloy according to claim 1, that when compared with AA7040 having a 20% recrystallization rate, possesses statistically significantly lower crack propagation rates on a $\Delta K=8$ to 20 MPa$\sqrt{m}$ for a test performed at R=0.1 in the L-T direction at the T/4 location.

5. An alloy of claim 4 wherein said $\Delta K=10$ MPa$\sqrt{m}$.

6. An alloy of claim 4 wherein Zr is present in an amount from about 0.04 to about 0.06 wt %.

7. A product according to claim 1 wherein $K_{IC(L-T)}>30$ MPa$\sqrt{m}$.

8. A product according to claim 2 wherein $K_{IC(L-T)}>30$ MPa$\sqrt{m}$.

9. A product according to claim 3 wherein $K_{IC(L-T)}>30$ MPa$\sqrt{m}$.

10. A product according to claim 7, wherein $K_{IC(T-L)}>25$ MPa$\sqrt{m}$.

11. A product according to claim 7, wherein $K_{IC(S-T)}>25$ MPa$\sqrt{m}$.

12. A product of claim 1 having a recrystallization rate up to about 90%.

13. A method for making a product of claim 1: comprising rolling a precursor to said product at a temperature that is less than 420 degrees C.

14. A method according to claim 13, wherein said product is subjected to T7651 temper.

15. A method for making a product of-claim 2: comprising rolling a precursor to said product at a temperature that is less than 420 degrees C.

16. A method according to claim 13, wherein said plate is subjected to T7651 temper.

17. A method of claim 13 wherein said temperature is at most 315 degrees C.

18. A method of claim 15, wherein said temperature is at most 315 degrees C.

* * * * *